United States Patent [19]

Elliott, Jr. et al.

[11] 4,042,975

[45] Aug. 23, 1977

[54] MEANS FOR PROTECTING BATTERS FROM HAND INJURIES

[75] Inventors: Albert Winslow Elliott, Jr., Costa Mesa; Albert W. Elliott, III, Long Beach, both of Calif.

[73] Assignee: New Products Development, Inc., Downey, Calif.

[21] Appl. No.: 672,651

[22] Filed: Apr. 1, 1976

[51] Int. Cl.[2] ..... A41D 13/08

[52] U.S. Cl. ..... 2/19; 2/161 A

[58] Field of Search ..... 2/159, 16, 19, 161 A, 2/161 R, 162, 158, 160, 20, 18; 128/157, 165, 166, 77, 133; 273/183 B

[56] References Cited

U.S. PATENT DOCUMENTS

| | | | |
|---|---|---|---|
| 1,502,871 | 7/1924 | Noyes | 2/161 R |
| 2,082,574 | 6/1937 | Handley | 2/16 |
| 2,118,360 | 5/1938 | Sager | 2/161 R |
| 2,154,197 | 4/1939 | Callaway | 2/161 R |
| 2,432,325 | 12/1947 | McDougall | 2/160 |
| 3,274,616 | 9/1966 | Russo | 2/161 A |
| 3,885,249 | 5/1975 | Brabander | 2/161 R |
| 3,918,096 | 11/1975 | Lim | 2/161 A |

FOREIGN PATENT DOCUMENTS

| | | | |
|---|---|---|---|
| 1,200,432 | 12/1959 | France | 2/160 |
| 1,013,381 | 12/1965 | United Kingdom | 2/161 R |

*Primary Examiner*—G. V. Larkin

*Attorney, Agent, or Firm*—Christie, Parker & Hale

[57] ABSTRACT

A pair of protective plates are releasably secured to the back side of a glove. One plate covers the back of the hand and the other plate covers the lower portions of the fingers. The two plates are spaced apart to allow freedom of movement of the knuckles at the base of the fingers, but the plates are spaced sufficiently close to each other to protect these knuckles. When used with a batter's glove the plates conform to the curved configuration of the hands while gripping a bat, and the plates are configured so as to prevent interference between them when the bat is swung. For other uses, such as motorcross, the plates have a slightly different configuration.

41 Claims, 9 Drawing Figures

MEANS FOR PROTECTING BATTERS FROM HAND INJURIES

BACKGROUND

This invention relates to a means for protecting the hands of a wearer against serious injury and is particularly useful to protect a batter from injury caused by being hit in the hands by a pitch while the batter's hands are gripping a bat and to protect a motorcross participant from flying debris, including rocks.

A batter's hands are very vulnerable to being hit by a pitch. In recent years a number of baseball players have suffered broken hands from being hit in the hands by a pitch while batting. A fractured hand can typically keep a player out of action for 6 to 8 weeks. However, a great many more players who are hit on the hands by a pitch suffer bruises, swelling, or soreness which may not keep them out of the game, but which hampers their batting and fielding ability.

The present invention is based on the recognition of the need to protect the hands of a batter from potentially serious injury and also the need to protect the hands of a motorcross participant.

SUMMARY

The invention will hereinafter be described in connection with use by a batter playing baseball although the use is not so limited. Briefly, the present invention, according to a presently preferred embodiment, comprises a first protective plate for covering the metacarpal area of a batter's hand, a second protective plate for covering the lower portions of the batter's fingers, and means for holding the first and second plates in a protective position overlying the back side of the batter's hand.

In a preferred form of the invention, the plates are adapted for releasable attachment to the back side of a batting glove or the like. The two plates are separately attached to the glove in spaced apart locations on opposite sides of the metacarpal phalangeal joints of the hand. This allows freedom of movement of these joints while the glove is worn with the protective plates. Means are provided to attach the plates sufficiently close together so they will protect the exposed metacarpal phalangeal joints from a ball hitting between the protective plates.

Preferably, the first plate protects the four metacarpal bones and extends from the vicinity of the wrist to just below the metacarpal phalangeal joints. The second plate protects the lower portions of all four fingers and extends from just above the metacarpal phalangeal joints to just below the first knuckles of the batter's hand. The plates are made from a rigid material and because of their size they provide protection by spreading the force of an impact over a broad area to greatly reduce the amount of force transferred directly to the hands of the batter.

These and other aspects of the invention will be more fully understood by referring to the following detailed description and the accompanying drawings.

DRAWINGS

DETAILED DESCRIPTION

Figure 1:
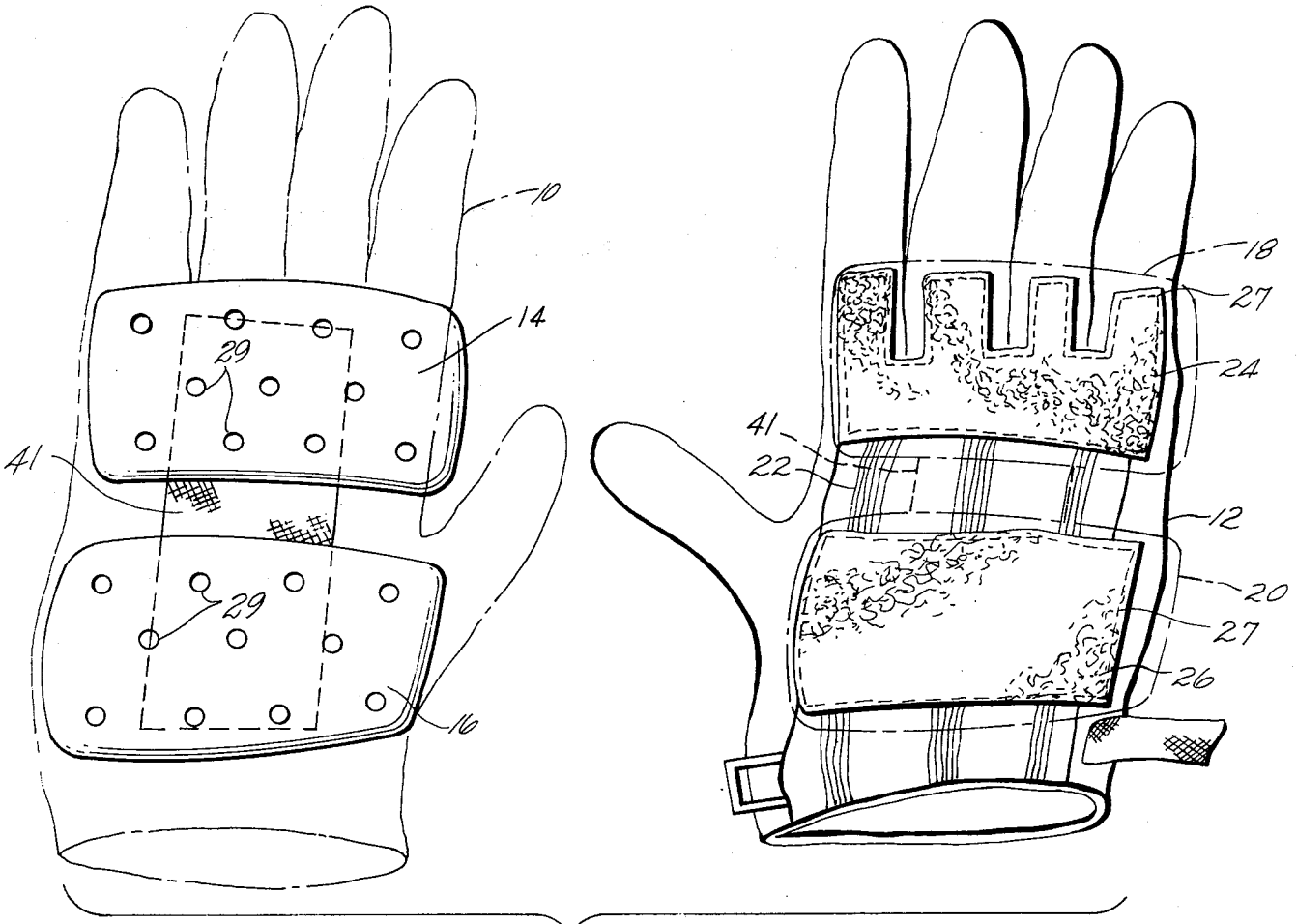
FIG. 1 is a top plan view, partly in phantom line, illustrating a pair of batting gloves and protective plates according to this invention.

FIG. 1 illustrates a pair of batting gloves 10 (shown in phantom lines) and 12 for the left and right hands, respectively, of a left-handed batter. The gloves provide a means for supporting the protective plates of this invention which are worn by a batter to protect his hands from serious injury if struck by a pitched ball. In a normal batting position before swinging at the ball, the batter's lead hand or hand nearest the end of the handle of the bat is turned so that the back of this hand faces the pitcher. The metacarpal bones of the lead hand are thus vulnerable to injury with the fifth metacarpal generally being the most vulnerable. Consequently, the protective plates of this invention preferably have an extension, on at least the plate for the back of the lead hand, that curves partially around the fifth metacarpal to protect this bone.

As shown in FIG. 1 on gloves for a left-handed batter, the back side of the left glove 10 supports an upper protective plate 14 and a lower protective plate 16 spaced below the upper plate 14. The back side of the right glove 12 supports an upper protective plate 18 (shown in phantom lines) and a lower protective plate 20 (shown in phantom lines) spaced below the upper plate 18. The protective plates are shown being used with batting gloves which are similar to handball gloves in that they cover the entire hand. These gloves are presently used by many baseball players to obtain a solid grip on a bat. However, the protective plates also can be used by attaching them to a golf glove, for example, or any other means of support worn on the batter's hands and covering at least the back side of the hands.

The batting gloves 10 and 12 are typically made from soft leather and the back side of each glove includes a centrally located section 22 of fabric which is stretchable laterally to accommodate fitting the glove onto the player's hand.

According to a presently preferred embodiment of the invention, an upper section 24 of thistle-cloth fastener material is secured to the back side of each glove so as to cover the lower portions of the fingers when the glove is worn. A lower section 26 of thistle-cloth fastener material is secured to the back side of the glove so as to cover the portion of the hand between the wrist and the knuckles at the base of the fingers (known as the metacarpal phalangeal joints) when the glove is worn. The upper and lower sections 24 and 26 of thistle-cloth material are the well known type sold under the trademark VELCRO. Preferably, these sections are the pile type of VELCRO material. The upper and lower VELCRO fasteners 24 and 26 are shown attached to the glove by rows of stitching 27, although they also can be adhesively bonded to the glove.

The upper and lower VELCRO fasteners 24 and 26 are spaced apart longitudinally rather than being continuous. The space between them coincides with the metacarpal phalangeal joints of the hand when the glove is worn. This allows complete freedom of movement of the glove in the stretchable area of the glove which covers the metacarpal phalangeal joints. The VELCRO fasteners 24 and 26 both extend substantially the entire width of the hand. The upper VELCRO fastener 24 has four separate extensions covering the lower portions of the four finger sections of the glove. The lower VELCRO fastener 26 is sufficiently wide to substantially overlie the second through fifth metacarpal bones of the lead hand when the glove is worn. The upper VELCRO section 24 extends lengthwise from just above the metacarpal phalangeal joints to just below the first knuckles of the fingers (known as the first interdigital joints). The lower VELCRO fastener 26 extends lengthwise from just above the wrist to just below the metacarpal phalangeal joints when the glove is worn.

Figure 2:
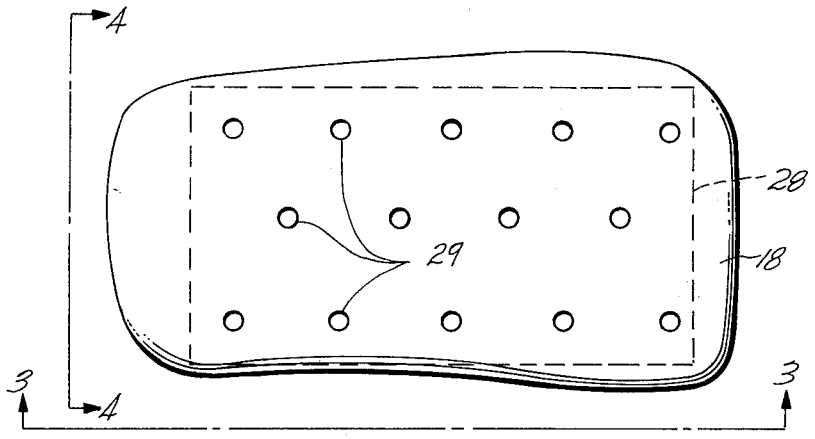
FIG. 2 is a top plan view showing a protective plate for the upper portion of a batting glove.
Figure 3:
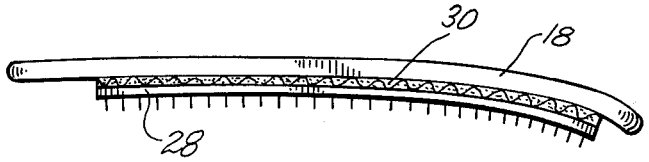
FIG. 3 is an elevation view, partly exaggerated in size, taken on line 3—3 of FIG. 2.
Figure 4:
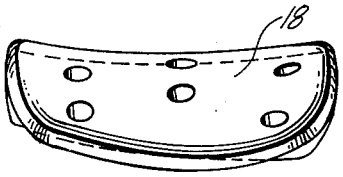
FIG. 4 is an elevation view taken on line 4—4 of FIG. 2.
Figure 5:
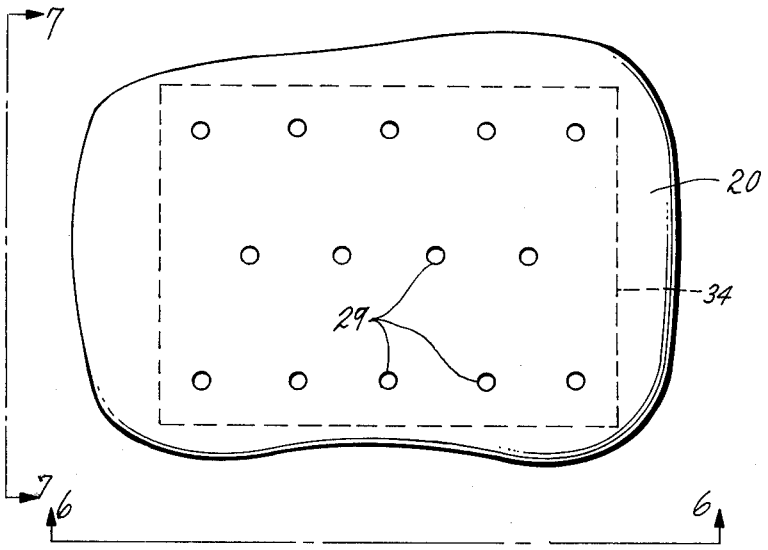
FIG. 5 is a top plan view showing a protective plate for the lower portion of a batting glove.
Figure 6:
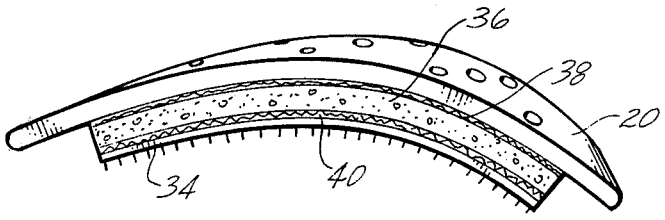
FIG. 6 is an elevation view, partly exaggerated in size, taken on line 6—6 of FIG. 5.
Figure 7:
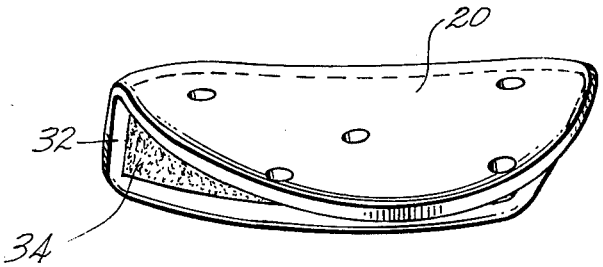
FIG. 7 is an elevation view taken on line 7—7 of FIG. 5.

FIGS. 2 through 4 illustrate the preferred configuration of the upper protective plate 18 for the right batting glove 12 for a left-handed batter illustrated in FIG. 1. FIGS. 5 through 7 illustrate the preferred configuration of the lower protective plate 20 for the right batting glove of FIG. 1. The protective plates 14 and 16 for the left batting glove are not illustrated in detail since they may be identical in configuration to the plates for the right batting glove. Similarly, the protective plates for the gloves of a right-handed batter are not illustrated in detail. These plates are mirror images of the plates for a left-handed batter so that the plates for the lead hand (left hand for right-handed batters) curve around the fifth metacarpal bone and the little finger. Additionally, the plates for the following hand (the right hand for right-handed batters) has a curved portion that tends to extend over the first metacarpal bone of that hand since this bone tends to be more exposed on the following hand than the fifth metacarpal of this hand.

The protective plates are rigid members which are generally rectangular in shape with rounded corners. They are preferably of relatively narrow cross-section, say about ⅛-inch thick. Preferably, the protective plates are made from a rigid plastic material to provide high impact strength as well as light weight. The protective plates add only about ½ ounce of weight per glove. The presently preferred material is a mixture of 90% polyurethane plastic with 10% nylon, although other rigid plastic materials, such as ABS or acrylic, can be used. The preferred plastic material also is one which is capable of injection molding techniques for efficient mass production of the protective plates. The protective plates preferably are molded with rows of spaced apart lightening holes 29.

The upper protective plate 18 is configured so as to cover the lower portions of the batter's four fingers. The long dimension of the plate 18 extends the width traversed between the index finger and little finger of the hand. The short dimension of the upper plate 18 extends from the vicinity of just above the metacarpal phalangeal joints to just below the first interdigital joints. The upper plate 18 is slightly curved across its width so as to conform generally to the shape of the lower portions of the four fingers. At the right end of the plate for a left-handed batter the plate curves around the little finger of the right hand. This shape is best illustrated generally in FIG. 3 which shows that the plate 18 has a relatively shallow curvature from end-to-end with a more pronounced curvature at the right end.

As shown best in FIG. 2, a section 28 of a thistle-cloth fastener material covers a major portion of the undersurface of the upper protective plate 18. The VELCRO fastener 28 is attached to the underside of the plate 18 by a layer 30 of adhesive. Preferably, the fastener section 28 is the hook type of VELCRO material for being frictionally engaged with the cooperating VELCRO fastener 24 on the glove.

The lower protective plate 20 has a long dimension which extends substantially the entire width of the hand so as to cover the second through fifth metacarpal bones of the lead hand. The short dimension of the lower plate 20 extends from just above the wrist to just below the metacarpal phalangeal joints. The lower protective plate 20 is slightly curved across its width so as to conform generally to the shape of the metacarpal area of the hand when a batter is gripping a bat. This shape is best illustrated generally in FIG. 6 which shows how the plate has a steeper curvature than the upper plate 18 so as to conform to the more rounded contour of the lower portion of the hand when gripping a bat. As shown best in FIG. 7, the right edge of the plate 20 (as viewed in FIG. 5) has a steep downward slope at 32 to project around the edge of the hand so as to provide good protection for the fifth metacarpal bone of the lead hand which is especially vulnerable to injury.

As shown best in FIGS. 5 and 6, a section 34 of thistle-cloth fastener material covers a major portion of the undersurface of the lower protective plate 20. Preferably, the fastener section 34 is the hook type of VELCRO material for being frictionally engaged with the cooperating VELCRO pile material 26 on the glove 12. FIG. 6 also illustrates that the protective plate 20, as well as any other protective plate, may have a thin layer 36 of shock-absorbing cushioning, such as a resilient polyurethane foam material, for example. FIG. 6 also illustrates that the layer 36 of cushioning may be attached to the underside of the plate by a layer 38 of adhesive, and that the VELCRO fastener 34 may be secured to the lower face of the cushioning layer 36 by a second layer 40 of adhesive.

In use, the fastener sections of the upper and lower protective plates 18 and 20 are releasably attached to the corresponding fastener sections on the glove 12 so as to attach the plates to the glove in the spaced apart positions illustrated in FIG. 1. Similarly, the upper and lower plates 14 and 16 are releasably attached to the glove 10 in the same spaced apart relation. The spacing between the protective plates coincides with the area of the glove overlying the metacarpal phalangeal joints of the hand. Thus, a batting glove having the protective plates attached to it does not restrict any freedom of movement of the metacarpal phalangeal joints of the batter's hand. The upper and lower plates are configured so that when they are located in the desired position on the glove, the spacing between them is sufficiently narrow to prevent the curvature of a baseball from making any substantial contact with the exposed metacarpal phalangeal joints of the batter's hand.

The detailed configurations of the protective plates 14 and 16 for the left hand glove 10 generally are the same as the configuration of the plates 18 and 20. The plates on the left glove do not interfere with those on the right glove when a left-handed batter is gripping a bat with both hands because of the separation between the plates in use. The rounded corners of the plates also help prevent the protective plates from interfering with one another during the batter's swinging motion. The edges of the protective plates 14 and 16 on the hand which is in the following position (as defined by the batting grip) do not extend over the fifth metacarpal bone or the little finger of this hand. However, the plates 14, 16, 18 and 20 are configured so that the spacing between those on one hand and those on the other hand is sufficiently narrow to prevent the curvature of a baseball from making any substantial contact with the exposed areas at the junction between the batter's hands.

FIG. 1 illustrates that the upper and lower protective plates for either glove can be attached to a common strip 41 of a flexible material for convenience in properly locating the two plates on a given glove. Preferably, the strip 41 is made from a longitudinally stretchable material, such as rubberized nylon, to allow the spacing between the plates to be adjusted.

Figure 8:
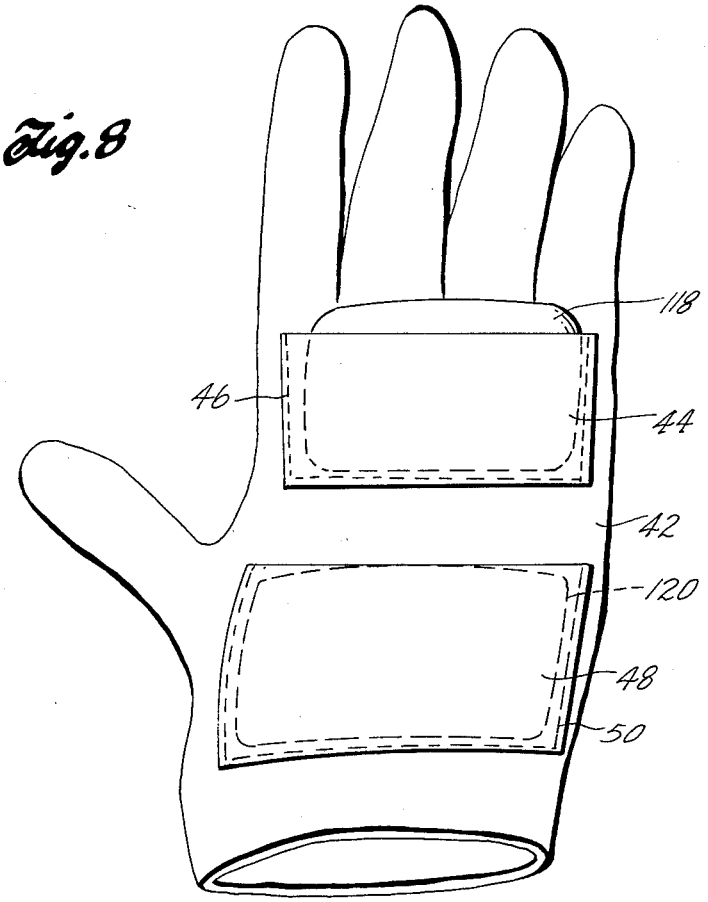
FIG. 8 is a top plan view illustrating an alternate form of the batting glove and protective plate combination of this invention.

FIG. 8 illustrates an alternate form of the invention in which a batting glove 42 includes an upper pocket 44 attached to the back side of the glove by a row of stitching 46. The upper pocket 44 has an open top for releasably receiving and retaining an upper protective plate 118 similar in shape to that of the upper plate 18. The upper pocket 44 holds the protective plate 118 in substantially the same position as that described above for the upper protective plate 18.

Similarly, the batting glove 42 includes a lower pocket 48 attached to the back side of the glove by stitching 50. The lower pocket 48 includes an open top for releasably receiving and retaining a protective plate 120 similar in shape to that of the lower protective plate 20 described above. The pocket 48 holds the plate 120 in a position on the glove substantially identical to that described above for the lower plate 20.

Figure 9:
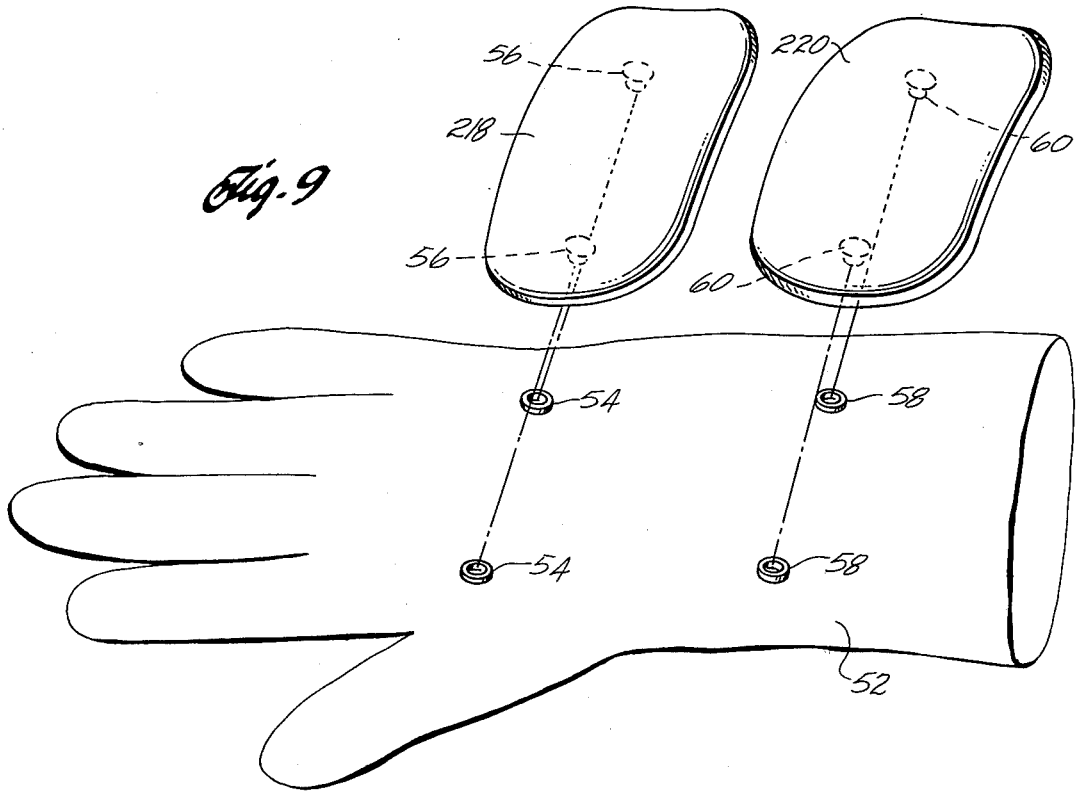
FIG. 9 is an exploded perspective view showing a further alternate form of the batting glove and protective plate combination of this invention.

FIG. 9 illustrates a further alternate form of the invention in which the upper and lower plates are attached to the gloves by snap ring fasteners. In this form the lower protective plates 218 and 220 are substantially identical in construction to the protective plates 18 and 20, respectively described above. A pair of laterally spaced apart female snap ring fasteners 54 are attached to the portion of the glove covering the lower portions of the fingers. A pair of cooperating male snap ring fasteners 56 are attached to the undersurface of the protective plate 218. Similarly, a pair of laterally spaced apart female snap ring fasteners 58 are attached to the back side of the glove on the portion which covers the metacarpal area of the hand. A pair of spaced apart male snap ring fasteners 60 are attached to the undersurface of the protective plate 220. The snap ring fasteners allow the upper and lower plates to be easily attached to and detached from the glove. The fasteners also may be arranged, other than as shown, to enable the upper and lower protective plates to be attached to the glove only when the two plates are in the correct alignment.

Thus, the invention provides a means for reducing the amount of impact transferred directly to a batter's hands when a batter is hit on the hands by a pitched ball. The protective plates spread the impact over a broad area, yet do not impede the mobility of the batter's hands while batting. It will be understood that the protective plates can be molded in a variety of shapes and sizes to fit the hands of different players without departing from the scope of the invention.

What is claimed is:

1. The combination comprising a pair of gloves for covering the right and left hands, in which each glove has a rear surface covering the back side of the hand and the rear surface has a lower portion covering the metacarpal area of the hand and an upper portion covering the lower portions of the fingers, first attachment means secured to the lower portion of one of said gloves for releasably attaching a first protective device to that portion of the glove; second attachment means secured to the upper portion of said one glove for releasably attaching a second protective device to that portion of the glove; third attachment means secured to the lower portion of the other of said gloves for releasably attaching a third protective device to that portion of the glove; and fourth attachment means secured to the upper portion of said other glove for releasably attaching a fourth protective device to that portion of the glove.

2. The combination according to claim 1 in which the first and third attachment means comprise thistle-cloth material covering the width of the four metacarpal bones of the hand and extending from the vicinity of the wrist to immediately below the metacarpal phalangeal joints of the hand.

3. The combination according to claim 2 in which the second and fourth attachment means comprise thistle-cloth material covering the width of the four fingers of the hand and extending from immediately below the metacarpal phalangeal joints to immediately below the first interdigital joints of the fingers.

4. The combination according to claim 1 in which the first and third protective devices comprise first and third rigid protective plates each having a width to cover the four metacarpal bones of the hand, and means secured to the first and third plates, respectively, for being releasably attached to the first and third attachment means, respectively.

5. The combination according to claim 4 in which the second and fourth protective devices comprise second and fourth rigid protec ive plates each having a width to cover the lower portions of the four fingers of the hand, and means secured to the second and fourth plates, respectively, to releasably attach the plates to the second and fourth attachment means, respectively, the first and second plates being attachable to their corresponding glove in a spaced apart relation and the third and fourth plates being attachable to their corresponding glove in a spaced apart relation to allow freedom of movement of the metacarpal phalangeal joints of each hand.

6. The combination according to claim 5 in which the plates for being attached to one glove are similar in configuration to the plates for being attached to the other glove to prevent interference between the two gloves when a batter wearing the gloves grips a bat.

7. The combination according to claim 5 in which each plate is curved across its width to conform to the curvature of the hand when gripping a bat.

8. The combination according to claim 5 in which the first, second, third and fourth attachment means comprise respective thistle-cloth fastening means, and in which the means secured to the first, second, third and fourth plates for releasably attaching the respective plates to their respective gloves comprise cooperating thistle-cloth fastening means on each plate.

9. The combination according to claim 5 including a first elongated flexible strip, means securing the first and second plates in a spaced apart relation to the first strip, the spacing between the first and second plates allowing said plates to be releasably attached to the first and second attachment means, respectively; and an elongated second flexible strip, and means securing the third and fourth plates in a spaced apart relation to the second strip, the spacing allowing said plates to be releasably fastened to the third and fourth attachment means, respectively.

10. The combination according to claim 9 in which each strip is stretchable so the spacing between the two plates on said strip can be adjusted.

11. For use with a glove having a rear surface covering the back side of a hand in which the lower portion of the glove covers the metacarpal area of the hand and an upper portion of the glove covers the lower portions of the fingers above the metacarpal phalangeal joints of the hand, means for protecting the hand of a person wearing said glove comprising a rigid lower protective plate for covering said lower portion of the glove, a rigid upper protective plate for covering said upper portion of the glove, means on the lower plate for releasably fastening the lower plate to said lower portion of the glove, and means on the upper plate for releasably fastening the upper plate to said upper portion of the glove.

12. The protective means according to claim 11 in which the lower plate is configured so that in its attached position it extends from the vicinity of the wrist to immediately below the metacarpal phalangeal joints of the hand.

13. The protective means according to claim 12 in which the lower plate is configured so that in its attached position it substantially covers four metacarpal bones of the hand.

14. The protective means according to claim 13 in which the upper plate is configured so that in its attached position it extends from immediately above the metacarpal phalangeal joints of the hand to immediately below the first interdigital joints of the fingers, the upper and lower plates in their attached positions being spaced apart to allow freedom of movement of the metacarpal phalangeal joints of the hand.

15. The protective means according to claim 14 in which the upper plate is configured so that in its attached position it substantially covers the lower portions of the four fingers of the hand.

16. The protective means according to claim 15 in which each plate is curved across its width to conform to the corresponding shape of a hand gripping a bat.

17. The protective means according to claim 16 including an elongated flexible strip, and means attaching each plate in said spaced apart relation to the strip.

18. The protective means according to claim 16 in which each plate is made from hard plastic.

19. The protective means according to claim 15 in which the plates for the left hand of a right-handed batter are wider than the plates for the right hand of a right-handed batter, and vice versa for a left-handed batter.

20. Means for protecting the hand comprising:

a glove having a rear surface covering the back side of the hand in the matacarpal area of the hand;

first fastening means on said rear surface of the glove;

a rigid protective plate having spaced apart top and bottom edges and spaced apart side edges; and second fastening means on the protective plate for cooperating with said first fastening means to releasably secure the protective plate in a fixed position covering said rear surface;

the protective plate, in said fixed position, having said side edges sufficiently spaced apart to substantially cover the four metacarpal bones of the hand extending from said bottom edge being in the vicinity of the wrist to said top edge being immediately below the metacarpal phalangeal joints of said hand, with said first and second fastening means allowing freedom of movement of said metacarpal phalangeal joints and allowing freedom of movement of the thumb of said hand.

21. Protective means according to claim 20 in which the rigid plate is curved across its width to conform to the curvature of the hand when gripping a bat.

22. Protective means according to claim 20 in which the plate is made from hard plastic.

23. Protective means according to claim 22 in which the first and second fastening means comprise cooperating sections of thistle-cloth material.

24. Means for protecting the hand comprising:

a glove having a rear surface covering the back side of the hand, the glove rear surface having a lower portion covering the metacarpal area of the hand and an upper portion covering the lower portions of the fingers;

first fastening means on said lower portion of the glove rear surface;

second fastening means on said upper portion of the glove rear surface;

a rigid lower protective plate having spaced apart top and bottom edges and spaced apart side edges;

a rigid upper protective plate having spaced apart top and bottom edges and spaced apart side edges;

third fastening means on the lower protective plate for cooperating with said first fastening means to releasably secure the lower plate in a fixed position covering said lower portion of the glove rear surface; and fourth fastening means on the upper protective plate for cooperating with said second fastening means to releasably secure the upper plate in a fixed position covering said upper portion of the glove rear surface;

the lower protective plate, in its fixed position, having its side edges sufficiently spaced apart to substantially cover the four metacarpal bones of the hand extending from its bottom edge being in the vicinity of the wrist to its top edge being immediately below the metacarpal phalangeal joints of said hand;

the upper protective plate, in its fixed position, having its side edges sufficiently spaced apart to substantially cover the lower portions of the four fingers extending from its bottom edge being immediately above the metacarpal phalangeal joints to its top edge being immediately below the first interdigital joints of said four fingers;

the lower and upper plates, in their fixed positions, being spaced apart to allow freedom of movement of the metacarpal joints of the hand and also allowing freedom of movement of the thumb of said hand.

25. Protective means according to claim 24 in which the upper and lower protective plates are made from hard plastic.

26. Protective means according to claim 25 in which the first and third fastening means comprise cooperating sections of thistle-cloth material, and the second and fourth fastening means also comprise cooperating sections of thistle-cloth material.

27. Protective means according to claim 24 including an elongated flexible strip securing the upper and lower plates in said spaced apart relation.

28. A glove worn on the hand, the glove having a rear surface for covering the backside of the hand, the glove rear surface having a lower portion covering the metacarpal area of the hand, and an upper portion covering the lower portions of the fingers; lower securing means on the lower portion of the glove; upper securing means on the upper portion of the glove; a lower rigid protective plate for cooperating with the lower securing means to hold the lower protective plate on the lower portion of the glove, the lower protective plate extending over the four metacarpal bones of the hand when releasably secured to the lower securing means; an upper rigid protective plate for cooperating with the upper securing means to releasably secure the upper protective plate over the upper portion of the glove, the upper protective plate extending over the lower portions of the four fingers when releasably secured to the upper securing means; the upper and lower protective plates being separate from one another so as to allow freedom of movement of the glove portion covering the metacarpal phalangeal joints of the hand.

29. The glove according to claim 28 including means on the lower protective plate for being releasably secured to the lower securing means, and means on the upper protective plate for being releasably secured to the upper securing means.

30. The glove according to claim 29 in which the lower securing means comprises thistle-cloth material secured to the area of the glove covering the four metacarpal bones of the hand, and the upper securing means comprises thistle-cloth material secured to the lower portions of the four fingers of the glove; in which the means for releasably securing the lower protective plate comprises thistle-cloth material extending over a sufficient width of the plate to releasably secure the lower plate to the thistle-cloth material covering the metacarpal bones of the hand; and in which the means for releasably securing the upper protective plate comprises thistle-cloth material extending over a sufficient width of the plate to releasably secure the upper protective plate to the thistle-cloth material covering the lower portions of the four fingers.

31. The glove according to claim 28 in which the upper and lower securing means comprise upper and lower enclosures, respectively, formed on the upper and lower portions, respectively, of the glove for releasably retaining the upper and lower protective plates, respectively.

32. The glove according to claim 29 in which the lower securing means comprise spaced apart first fasteners secured to the lower portion of the glove, and the lower securing means comprises spaced apart second fasteners secured to the lower protective plate; and the upper fastening means comprise spaced apart third fasteners secured to the upper portion of the glove, and the means releasably securing the upper plate to the upper glove portion comprises spaced apart fourth fasteners secured to the upper protective plate.

33. The glove according to claim 28 in which the upper protective plate, in said fixed position releasably secured to the upper portion of the glove, has side edges sufficiently spaced apart to substantially cover the four metacarpal bones of the hand extending from a bottom edge of the plate being in the vicinity of the wrist to a top edge of the plate being immediately below the metacarpal phalangeal joints of the hand, with the lower fastening means allowing freedom of movement of the thumb of the hand.

34. The glove according to claim 33 in which the upper protective plate, in its fixed position releasably secured to the upper securing means, has opposite side edges sufficiently spaced apart to substantially cover the lower portions of the four fingers extending from a bottom edge being immediately above the metacarpal phalangeal joints to a top edge being immediately below the first interdigital joints of the four fingers, the upper protective plate, in its fixed position, allowing freedom of movement of the thumb of the hand.

35. The glove according to claim 34 in which the upper and lower protective plates are made from hard plastic.

36. The glove according to claim 28 in which the upper and lower protective plates are made from hard plastic.

37. The glove according to claim 28 in which the upper and lower protective plates are curved across their width to conform to the curvature of the hand when gripping a bat.

38. The glove according to claim 28 in which the glove lower portion has a width covering the four metacarpal bones of the hand, and the glove upper portion has a width covering the lower portions of the four fingers of the hand; and the lower protective plate extends the width of the glove lower portion; and the upper protective plate extends the width of the glove upper portion.

39. The glove according to claim 38 in which the glove lower portion has a longitudinal dimension extending from the vicinity of the wrist to a location immediately below the metacarpal phalangeal joints of the hand, and the glove upper portion has a longitudinal dimension extending from immediately above the metacarpal phalangeal joints to immediately below the first interdigital joints of the four fingers; and in which the lower protective plate extends the longitudinal dimension of the lower glove portion, and the upper protective plate extends the longitudinal dimension of the upper glove portion.

40. The glove according to claim 39 in which the upper and lower protective plates are made from hard plastic.

41. The glove according to claim 40 including means on the upper and lower protective plates for releasably securing the plates to the upper and lower portions, respectively, of the glove.

* * * * *